United States Patent [19]

Leiponen et al.

[11] Patent Number: 4,806,213

[45] Date of Patent: Feb. 21, 1989

[54] METHOD AND APPARATUS FOR STRIPPING ELECTROLYTIC PRECIPITATE FROM SUPPORTING STRUCTURES

[75] Inventors: Matti O. Leiponen, Espoo; Seppo J. Erlamo; Pentti K. Kujanpää, both of Kokkola; Olli E. Ylimäki, Espoo, all of Finland

[73] Assignee: Outokumpu Oy, Helsinki, Finland

[21] Appl. No.: 104,344

[22] Filed: Nov. 17, 1987

[51] Int. Cl.[4] ..... C25D 1/04; C25D 17/00

[52] U.S. Cl. ..... 204/12; 204/194

[58] Field of Search ..... 204/12, 194

[56] References Cited

U.S. PATENT DOCUMENTS 4,195,412 4/1980 Llop et al. ..... 33/169 R

*Primary Examiner*—T. M. Tufariello

*Attorney, Agent, or Firm*—Brooks Haidt Haffner & Delahunty

[57] ABSTRACT

The invention relates to a method and apparatus for stripping a thin, sheet-like layer of electrolytically accumulated metal precipitate (6) from its supporting structures (1) by means of a peeling blade (4) driven towards the upper edge of the precipitate layer (6). For the stripping operation, the supporting structure (1) is first attached to the stripping station by aid of gripping members (2, 3), the frame whereof advantageously provides a housing in common with the peeling blades (4). Moreover, the measuring and control members (7, 8) which are advantageously located in the common housing, are used in determining the surface profile of the supporting structure (1), and the obtained profile is made use of while choosing the orientation of the peeling blade (4).

10 Claims, 2 Drawing Sheets

Figure 1:
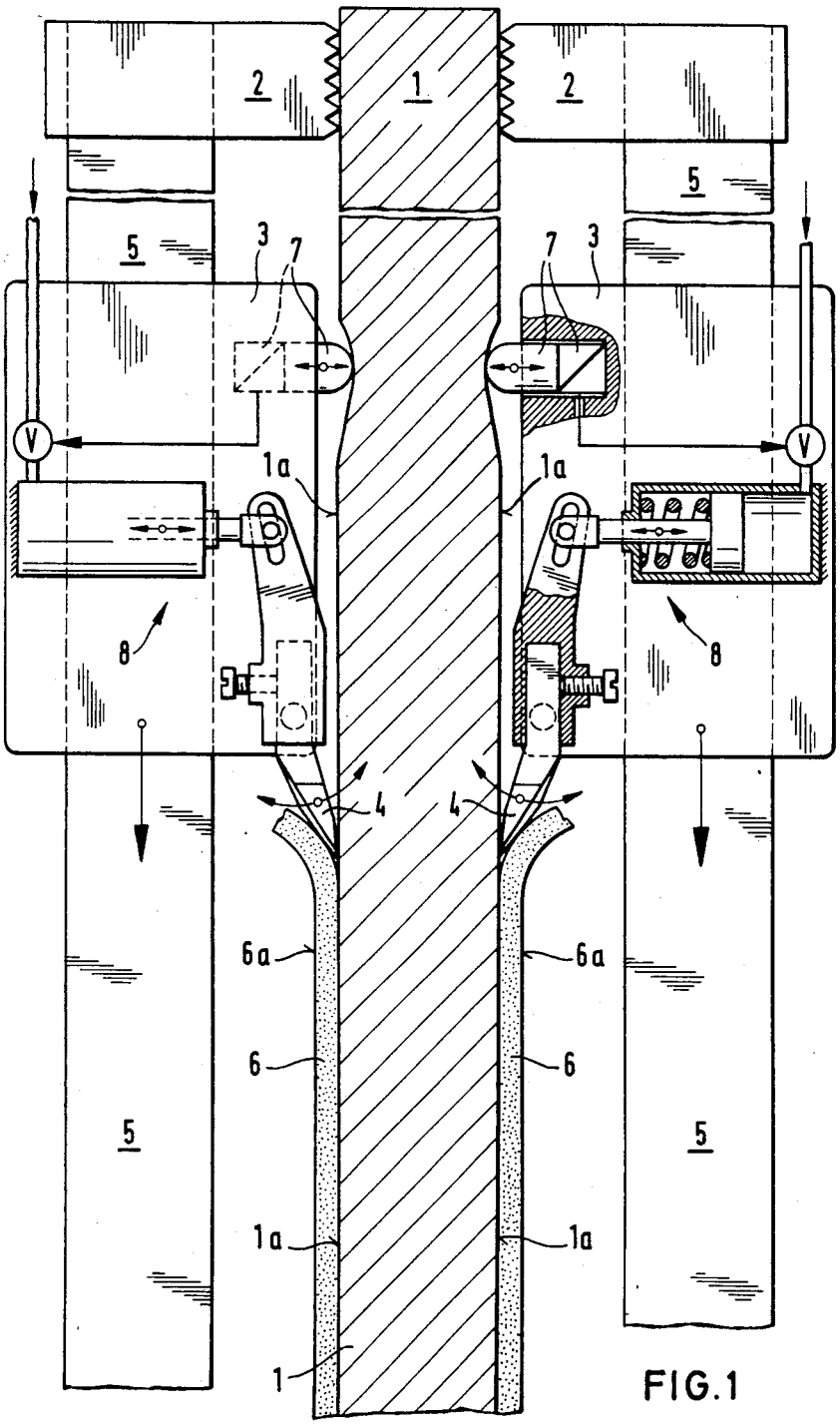

METHOD AND APPARATUS FOR STRIPPING ELECTROLYTIC PRECIPITATE FROM SUPPORTING STRUCTURES

The present invention relates to a method and apparatus for stripping thin, sheet-like layers of electrolytically accumulated metal precipitate from supporting structures such as a cathode sheet or a mother sheet by employing a peeling blade which is advantageously driven towards the upper edge of the precipitate.

In the electrolytic production of metal, such as zinc, it is customary to use an aluminium cathode sheet, on the surface whereof the metal layer is precipitated. The metal layer is stripped after the layer has reached sufficient thickness. In the stripping procedure there is commonly used a stripping machine comprising a peeling unit. The peeling unit wedges an aperture at the upper edge of the metal layer, whereafter the layer can be stripped in the stripping unit proper.

In the method introduced in the U.S. Pat. No. 3,689,396, the knife-like blades are driven under the metallic precipitate at the side edge by employing a hinged plastic guard, which prevents the metal precipitate from accumulating in the corner of the cathode sheet. In order to strip the metal layer, the guard member is opened, and the blades have access to under the precipitate layer through the aperture formed under the guard member. However, the cathode sheets are easily corroded under the guard members, which considerably shortens the working age of the cathode sheets. Hence the cathode sheets and their production bring about remarkable expenses.

The object of the present invention is to obviate some of the drawbacks of the prior art and to achieve an improved and cheaper method and apparatus for stripping metal precipitates from their supporting structures.

In order to perform an advantageous stripping according to the invention, the cathode sheet comprising the metal precipitate is firmly attached at the top edge by means of gripping members which form the frame guiding the peeling blades. The position of the gripping members with respect to the cathode sheet is advantageously chosen so that the jaws lock the cathode sheet on both sides of the corroded zone caused by the solution boundary of the electrolysis, so that the torques created in connection with the stripping do not turn or bend the cathode sheet. Moreover, the gripping members are employed for measuring, by aid of intermediate members, the depth of the corrosion in order to define the profile of the cathode sheet. On the basis of the obtained profile, the movement of the peeling blades is guided in conformity to the shape of the corrosion, so that the peeling blades move advantageously along the surface of the cathode sheet both in height and in depth, thus preventing any cutting of the cathode sheet which would lead to further damage.

The peeling blades of the apparatus of the invention are advantageously knife-like blades which are stick in between the metal precipitate and the cathode sheet on both sides of the sheet. The peeling blades wedge an advantageous aperture in between the metal precipitate and the cathode sheet, which is made use of in stripping the metal precipitate.

According to the invention, the metal precipitate is stripped off the cathode sheet with a minimum wearing of the cathode, whereby the working age of the cathode sheet is lengthened and the expenses caused by the sheets are essentially reduced. Moreover, work safety can be essentially improved, because now hazardous situations caused by damaged sheets arise more rarely than before, the probability of damaged sheets thus being minimized.

Figure 2:
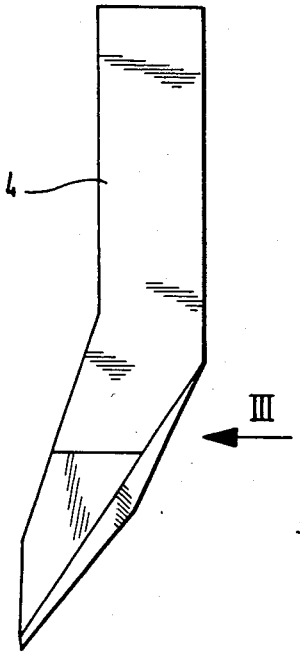
Figure 3:
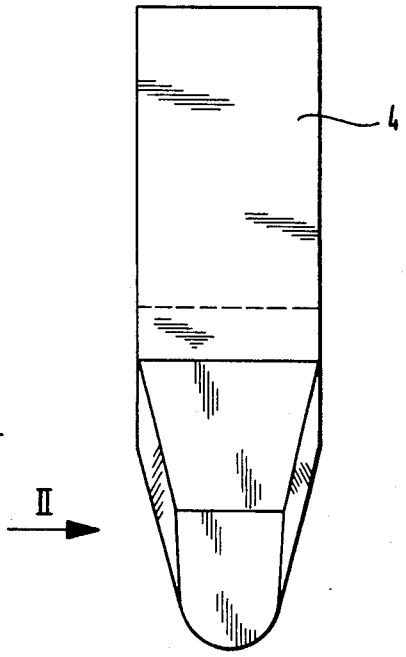

The invention is described in more detail with reference to the appended drawings, wherein FIG. 1 is a side-view illustration of a preferred embodiment of the invention;

FIG. 2 is a side-view illustration of the peeling blade of the embodiment of FIG. 1; and FIG. 3 is a front-view illustration of the peeling blade of the embodiment of FIG. 1.

For an advantageous realization of the method of the invention, the cathode sheet 1 lifted from the electrolytic bath is washed and conveyed to the stripping station according to FIG. 1. In the stripping station the cathode sheet 1 is fastened on both sides of the upper edge by means of two-part gripping members 2 and 3. The gripping members 2 and 3 are interconnected by aid of the frame 5, which at the same time serves as the housing for the peeling blades employed in the stripping procedure.

Before the stripping procedure proper, there is determined the profile of the cathode sheet 1, possibly deviating from a straight planar surface and formed of earlier removed metal precipitate layers and/or caused by the solution boundary of the electrolysis. The determination of the profile 1*a* is carried out by means of the measuring members 7 and control members 8, attached to the frame above the precipitate layer 6 formed on the cathode sheet 1. On the basis of the measured surface profile of the cathode sheet, the position of the peeling blades 4 with respect to the frame 5 for starting the stripping is chosen so that any wearing of the cathode sheet 1 owing to the stripping of the precipitate layer 6 can be essentially avoided.

The peeling blades 4 employed in the stripping are, as is apparent from FIGS. 2 and 3, knife-like in shape and have an advantageously bluntish and narrow point. The stripping motion of the peeling blades 4 is advantageously started vertically near the upper edge of the precipitate layer 6*a*, and the blades are driven, controlled by the control members 8, along the determined surface profile of the cathode sheet 1 so that the points of the peeling blades 4 are kept essentially near to the sheet surface also in the corroded zone of the sheet 1. Thus the peeling blades are essentially simultaneously driven both vertically and in depth in order to achieve an advantageous realization of the invention.

We claim:

1. A method for stripping a thin, sheet-like layer of electrolytically accumulated metal precipitate from a supporting structure, comprising attaching the supporting structure to a stripping station by means of gripping members, using measuring and control members to determine a surface profile of the supporting structure, orienting a peeling blade in accordance with the surface profile and moving the peeling blade in accordance with the surface profile toward an upper edge of said sheet-like layer.

2. The method of claim 1 and including gripping and supporting structure with said gripping members near an upper edge of said sheet-like layer.

3. The method of claim 1 or 2 and including using said gripping members in determining said surface profile.

4. The method of claim 1 or 2 moving the peeling blade essentially vertically from a position near said upper edge.

5. The method of claim 1 or 2 and including driving the peeling blade close to the surface of said supporting structure during stripping.

6. The method of claim 5 and including driving the peeling blade both vertically and toward the surface of the supporting structure.

7. An apparatus for stripping a thin, sheet-like layer of electrolytically deposited metal precipitate from a supporting structure, comprising gripping members for attaching the supporting structure to a frame at a stripping station, measuring and control members for determining a surface profile of said supporting structure, means for orienting a peeling blade in accordance with a measured surface profile of said supporting structure and means for moving the peeling blade toward an upper edge of said sheet-like layer in accordance with said surface profile.

8. The apparatus of claim 7 wherein said frame supports said peeling blade.

9. The apparatus of claim 8 wherein said frame houses said control members.

10. The apparatus of claim 7 and including stripping blades on opposite sides of said supporting structure for stripping a sheet-like layer off two opposite sides of said supporting structure.

* * * * *